US006042903A

United States Patent [19]

Yedlin et al.

[11] Patent Number: 6,042,903

[45] Date of Patent: Mar. 28, 2000

[54] ORNAMENT

[76] Inventors: Monte A. Yedlin, 1441 Virginia Ave., Glendale, Calif. 91202; Eugene E. Cheltenham, 1823 Hollyvista Ave., Los Angeles, Calif. 90027; Donald F. Rowan, 1201 Bayshore, Apt. 202, Long Beach, Calif. 90803

[21] Appl. No.: 09/190,068

[22] Filed: Nov. 12, 1998

[51] Int. Cl.[7] ..... D04D 7/10

[52] U.S. Cl. ..... 428/7; 428/101; 156/187

[58] Field of Search ..... 428/4, 7, 5, 101; 156/187

[56] References Cited

U.S. PATENT DOCUMENTS

| | | | |
|---|---|---|---|
| 3,457,134 | 7/1969 | Karkoska | 161/9 |
| 3,709,767 | 1/1973 | Saiga | 161/14 |
| 4,201,806 | 5/1980 | Cole | 428/4 |
| 4,886,688 | 12/1989 | Szabo | 428/7 |
| 5,130,169 | 7/1992 | Dejaynes | 428/7 |
| 5,609,928 | 3/1997 | Yedlin et al. | 428/5 |

*Primary Examiner*—Alexander Thomas
*Attorney, Agent, or Firm*—Jack C. Munro

[57] ABSTRACT

A suspending ornament that is designed primarily for Christmas trees that is composed of a sheet material member that is wound on a core member. The core member is to be adjustable in length and when shortened produces a tubular configuration of the sheet material. The sheet material member includes a mass of slits which produces an attractive stringy type of appearance when in the tubular configuration. The sheet material member should be designed to be colorful. There may be mounted on the core member a decoration which would be observable through the slits of the tubular configuration of the sheet material member changing the tubular configuration to a globular configuration.

20 Claims, 5 Drawing Sheets

ORNAMENT

BACKGROUND OF THE INVENTION

1) Field of the Invention

The present invention relates to decorative ornaments primarily for use on Christmas trees and other display usages.

2) Description of the Prior Art

There are numerous different types of decorative ornaments used to decorate Christmas trees, wreaths and the like. Also, decorative ornaments are commonly suspended from fixed structures located within homes. A common version of a decorative ornament is a suspension ornament where the ornament includes an attachment for attaching the ornament in a suspending manner to the item being decorated. Although there are numerous ornaments that have been previously designed, there is always a need for a novel configuration of ornament that is attractive in appearance.

SUMMARY OF THE INVENTION

The subject matter of the present invention comprises a tubular decorative ornament that is designed to be mounted in a suspending manner from the structure that is to be decorated. The decorative ornament includes an elongated, rigid core which is adjustable in length. To the ends of this core there is mounted in a winding manner a section of thin, flimsy, sheet material. This sheet material has been previously cut producing a mass of slits and between each directly adjacent pair of slits is located a thin, narrow strip of the sheet material. The sheet material is wound on the core with the sheet material attached only at the opposite ends of the core. Adjusting of the length of the core results in the sheet material changes the shape from tubular to various sizes of globular configurations. The slits can be arranged in different patterns within the section of sheet material with each pattern producing a slightly different appearance of the decorative ornament. A decoration may be fixedly mounted in conjunction with the core with the decoration being located interiorly of the globe but being observable through the slits which will produce an ornament of a different appearance.

One of the objectives of the present invention is to construct a decorative ornament which is most attractive in appearance and which can be manufactured at a relatively inexpensive price and therefore sold to the ultimate consumer at a rather inexpensive price.

Another objective of the present invention is to construct a decorative ornament that provides a new and unusual ornament for Christmas trees so that such can be decorated in a novel fashion.

DETAILED DESCRIPTION OF THE PREFERRED EMBODIMENT

Figure 1:
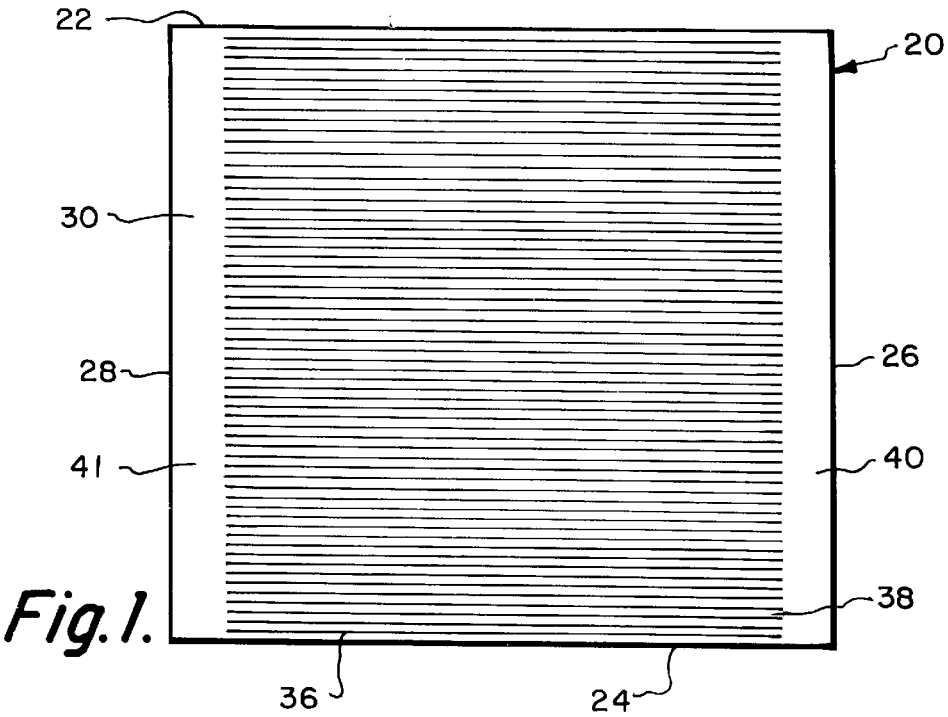
FIG. 1 is a top plan view of the sheet material which has a polygonal configuration of slits which is utilized to produce the decorative ornament of the present invention.
Figure 2:
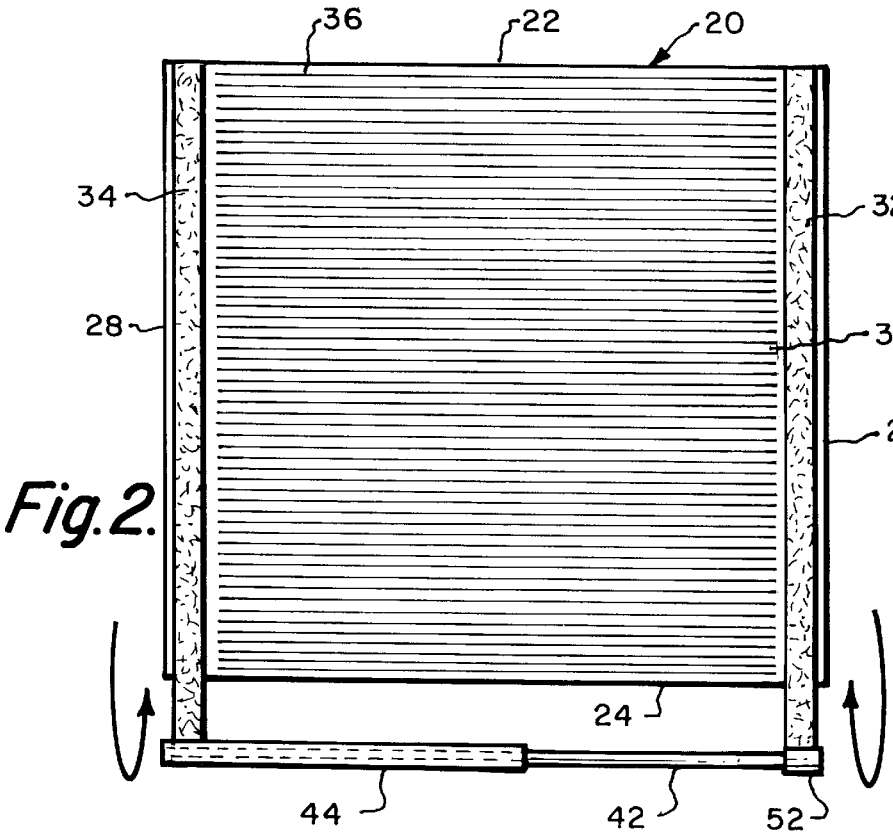
FIG. 2 is a top plan view of the sheet material of FIG. 1 showing such being mounted in conjunction with a core.
Figure 3:
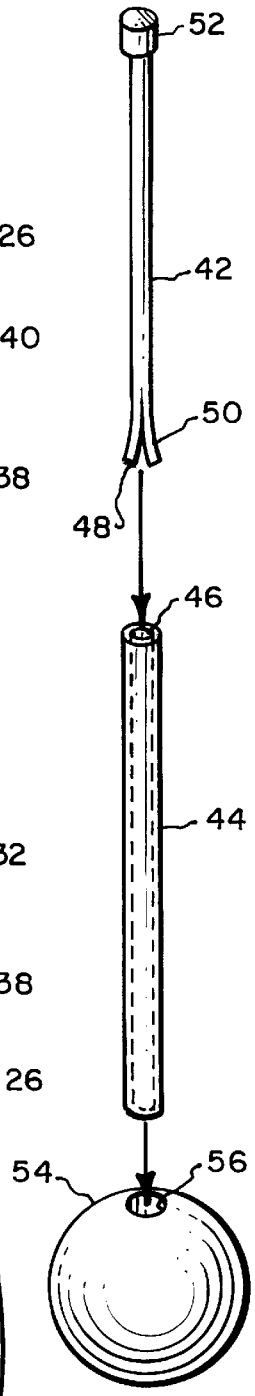
FIG. 3 is an exploded view of a core the decorative ornament of the present invention showing connection to a decoration which could be fixedly mounted on the core.
Figure 6:
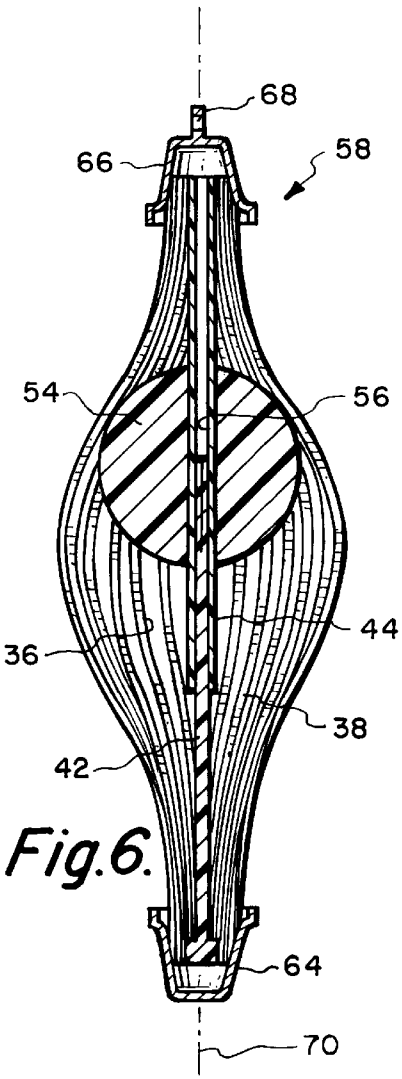
FIG. 6 is a cross-sectional view of the decorative ornament of the present invention taken along line 6—6 of FIG. 5 showing the decorative ornament with a decoration mounted on the core.
Figure 5:
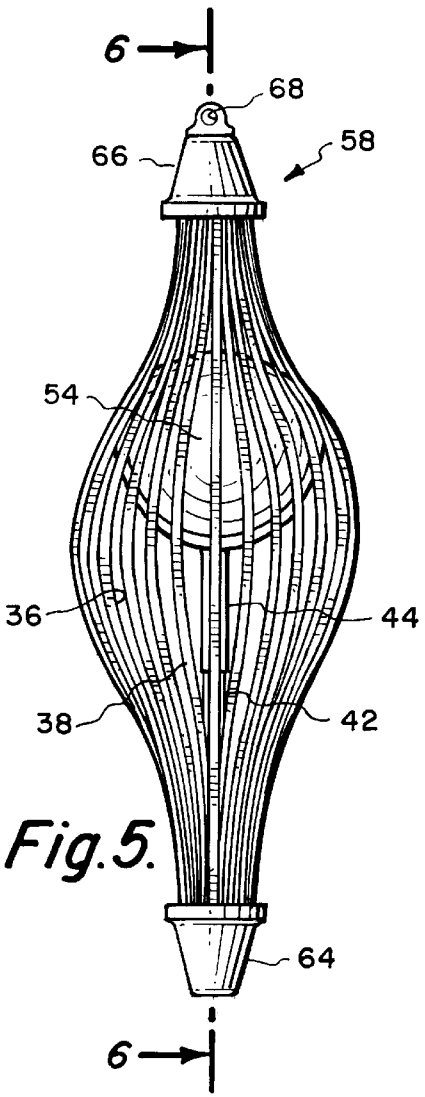
FIG. 5 is a view of the decorative ornament of the present invention similar to FIG. 4 but showing the decorative ornament in its completed stage of manufacture and showing the core in an extended position.
Figure 4:
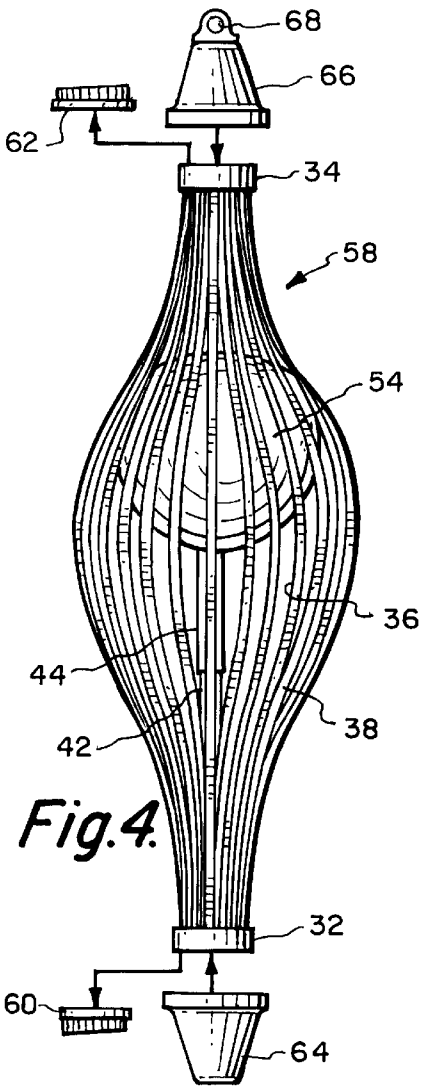
FIG. 4 is a front view of the decorative ornament of the present invention that has been constructed utilizing the sheet material section shown in FIG. 2 depicting the final, constructional steps that are required in order to produce the final configuration of the decorative ornament.

Referring particularly to FIGS. 1–7 of the drawings, there is shown a thin, flexible section 20 of sheet material. A preferable material of construction for the section 20 would be a metallic foil. However, the section 20 could be constructed of plastic and possibly even of paper. The section 20 should be highly colorful and possibly may include a design. The section 20 includes a top edge 22 and a bottom edge 24. The section 20 also includes a right side edge 26 and a left side edge 28. Mounted on the inner surface 30 directly adjacent the right side edge 26 is a adhesive border strip 32. A similar adhesive border strip 34 is mounted on the inner surface 30 directly adjacent the left side edge 28. The border strips 32 and 34 are located parallel to each other. Formed within the section 20 are a plurality of slits 36. Within section 20 there are actually fifty-nine in number of the slits 36. However, it is to be understood that the number of the slits 36 can be increased or decreased without departing from the scope of this invention. In between each pair of directly adjacent slits 36 is a narrow strip 38. Therefore, it is to be understood that there will be approximately sixty in number of the narrow strips 38. It is to be noted that the length of the slits 36 are all the same within the embodiment shown within FIGS. 1–7. The pattern of the slits 36 is that of a polygonal-shape such as a square or rectangle. The slits 36 terminate directly adjacent the border sections 40 and 41. Mounted on the border section 40 is a border strip 32 and mounted on the border section 41 is a border strip 34. Slits 36 constitute no more than a knife-type cut with all the cuts being parallel.

There is a core which is constructed of an inner member 42 and an outer member 44. The outer member 44 constitutes a cylindrical tube which has a through hole 46. Telescopingly mounted within the through hole 46 is the inner member 42. The inner member 42 is also cylindrical. The inner end 48 of the inner member 42 is formed into a plurality of flared fingers 50. These flared fingers 50 are to be inserted within the through hole 46 which creates a small amount of outwardly directed pressure against the wall of the through hole 46. The result is the inner member 42 is capable of telescoping movement relative to the outer member 44. Because of the flared fingers 50, this movement is not completely free but is a snug type of movement. At any point in this movement, the inner member 42 can be stopped and will remain in that position relative to the outer member 44. The outer end of the inner member 42 is formed into a cylindrical plug 52. The diameter of the plug 52 is equal to or greater than the diameter of the outer member 44.

It may be desirable to mount a form of decoration on the outer member 44. An example of such a decoration is a ball 54. The ball 54 includes a through hole 56 and a tight fit is to occur between the outer member 44 and the ball 54 when the outer member 44 is inserted within the hole 56. The ball 54 is to be positioned where desired and it will remain in that position relative to the outer member 44. It is to be understood that other than the ball 54, there could be utilized numerous different types of decorations.

The outer end of the outer member 44 is placed against the adhesive border strip 34. The cylindrical plug 52 is placed against the adhesive border strip 32. This locating of the core is such that the longitudinal center axis of the core is located parallel to the slits 36. The section 20 and the border strips 32 and 34 is then wound onto the core with border strip 34 being wound onto outer member 33 and border strip 32 being wound onto the cylindrical plug 52. The adhesiveness of the adhesive border strips 32 and 34 functions to fixedly secure section 20 to the core. It is to be understood that the decorative ornament of this invention may not include the ball decoration 54 and if so, the decorative ornament is in a tubular shape. With the ball decoration, the ornament assumes a globe shape. Once the adhesive border strips 32 and 34 are completely wound onto the core, it may be necessary to do a little trimming at each end of the decorative ornament 58 that is now produced. The removed material is shown as 62 from the border strip 34 and the removed material is shown as 60 from the border strip 32. Once the material 60 has been removed, a cap 64 is fixedly secured onto the decorative ornament covering the border strip 32. The cap 64 is to be fixedly secured in position by an adhesive, which is not shown.

A cap 66 is fixedly mounted about the border strip 34 and is similarly adhesively secured. It is to be noted that the cap 66 includes an eyelet hole 68. A hangar or a piece of string is designed to connect with the eyelet hole 68 permitting mounting in a suspended manner the decorative ornament 58 of this invention. It is to be noted that the decorative ornament 58 has a longitudinal center axis 70.

Figure 8:
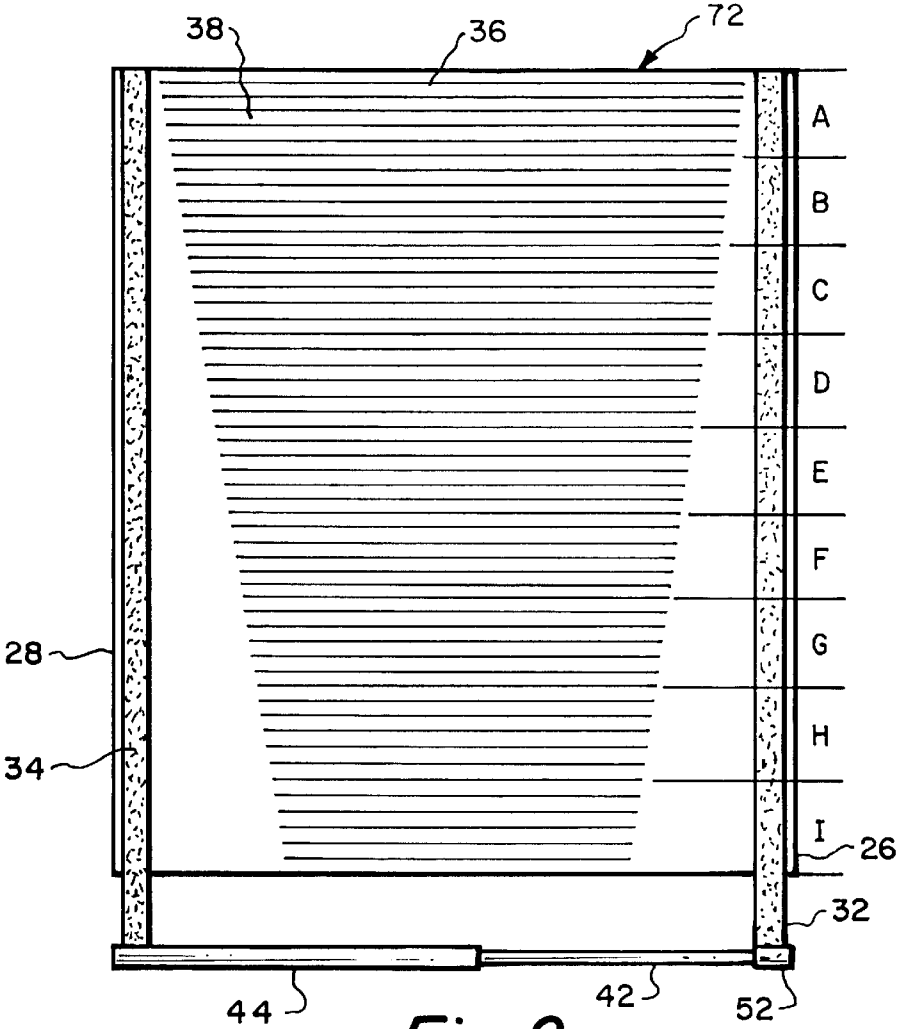
FIG. 8 is a top plan view of the sheet material for the decorative ornament of the present invention similar to FIG. 2 where the sheet material section has a truncated cone-shaped pattern of slits as opposed to the polygonal-shaped pattern of FIGS. 1 and 2.
Figure 7:
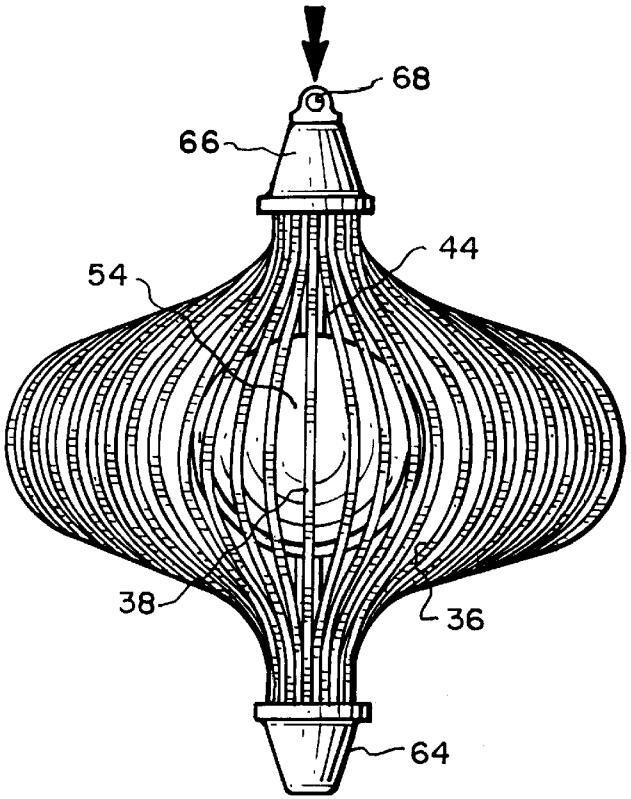
FIG. 7 is a view of the decorative ornament of the present invention similar to FIG. 5 but showing the core in a shortened position.
Figure 9:
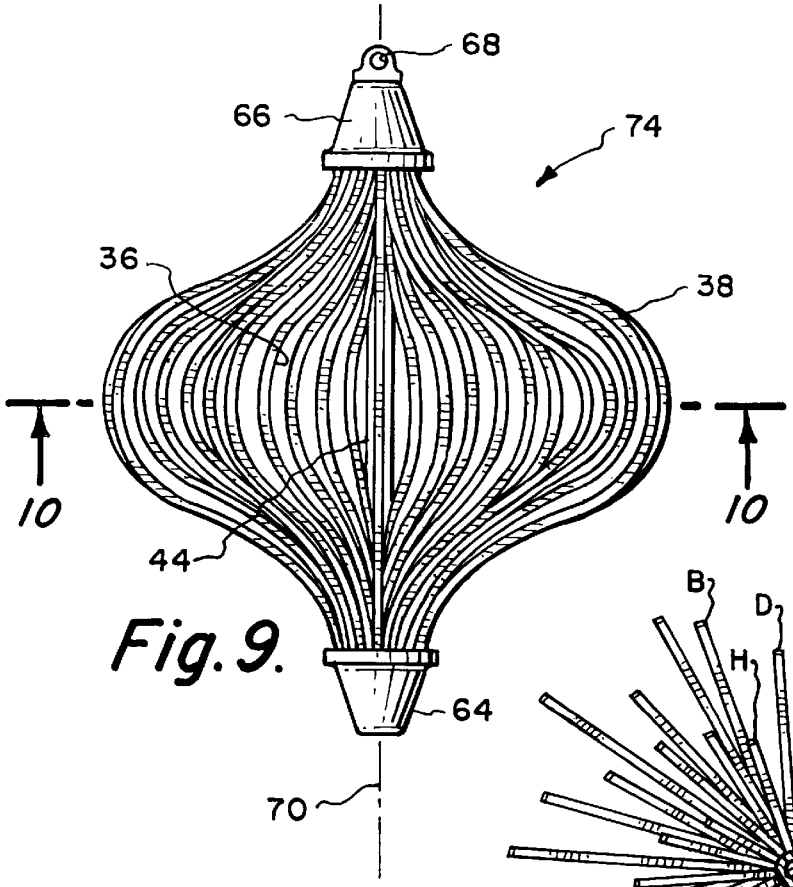
FIG. 9 is a view of the decorative ornament of the present invention constructed with the truncated cone-shaped slit pattern of FIG. 8 with the core of the decorative ornament in a shortened position.
Figure 10:
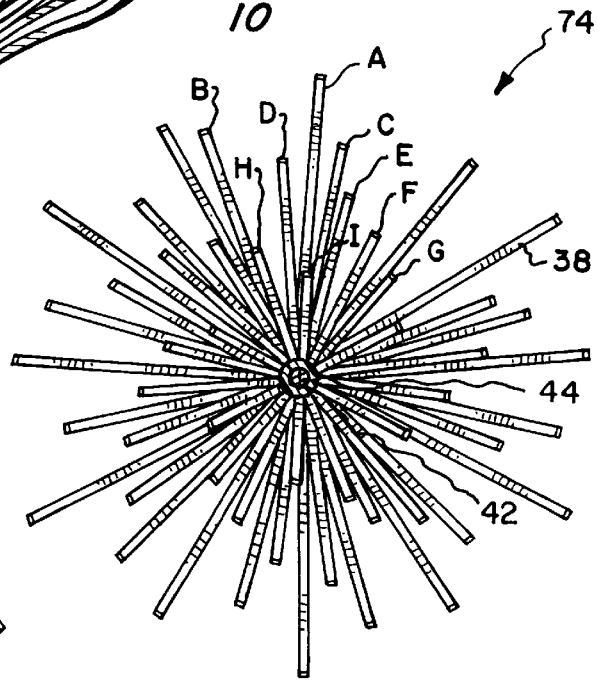
FIG. 10 is a cross-sectional view of the decorative ornament of the present invention taken along line 10—10 of FIG. 9.

Referring particularly to FIG. 8, there is a modified form of the decorative ornament of the present invention which shows a sheet material section 72 located in a flat, uninstalled position. Like numerals have been utilized to refer to like parts. The difference of the sheet material section 72 from the sheet material section 20 is in the pattern of the slits 36. It is noted that observing FIG. 8 that the pattern of the slits 36 is that of a truncated cone. To help to understand how this pattern differs from the polygonal-shaped pattern of FIGS. 1 and 2, the letters A, B, C, D, E, F, G, H, and I have been used to refer to different portions of the sheet material section 72. When the sheet material section 72 is wound on the core composed of inner member 42 and outer member 44 starting with the end of the section 72 that has the shortest length of slits 36, there is produced a decorative ornament as shown in FIG. 9 when the core is in the shortened position. The different portions of the sheet material section 72 that have been designated A to I are used to denote the different corresponding narrow strips in the cross-sectional view of FIG. 10. In observing of the cross-sectional view of FIG. 10, it can be seen that the strips 38 that are located within area A extend the farthest from the longitudinal center axis 70 of the decorative ornament 74 which is shown in FIGS. 9 and 10. Section B doesn't extend quite as far out as Section A, Section C doesn't extend quite as far out as Section B, Section D doesn't extend quite as far out as Section C and so forth until finally Section I locates the strips 38 that are shortest in length and extend the shortest distance out from the longitudinal center axis 70 and is closest to the center axis 70.

Figure 12:
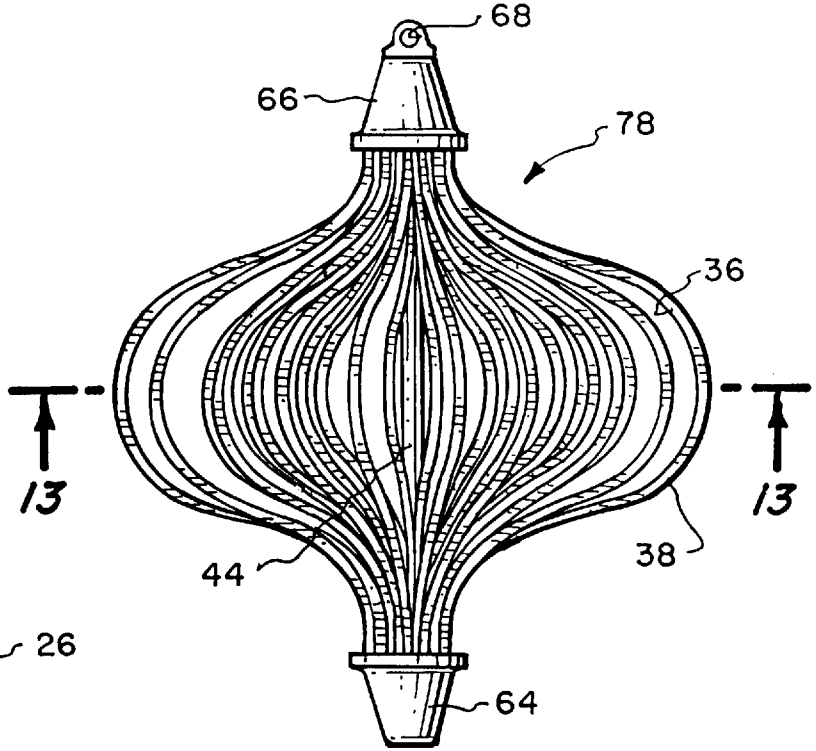
FIG. 12 is a front view of the decorative ornament of the present invention constructed utilizing the stepped slit pattern configuration shown in FIG. 11 with the core of the decorative ornament being located in a shortened position.
Figure 11:
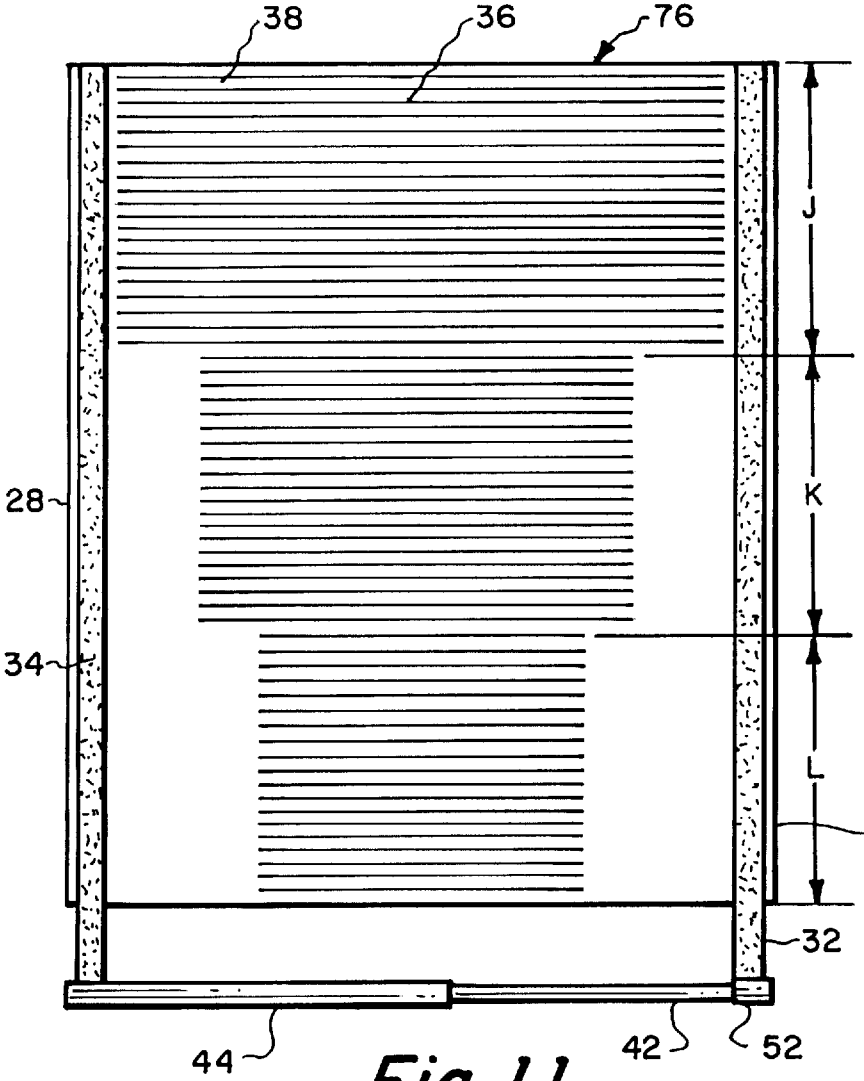
FIG. 11 is a top plan view of the sheet material for the decorative ornament of the present invention similar to FIG. 8 where the slit pattern assumes a stepped configuration rather than the truncated cone-shaped configuration of FIG. 8.

Referring particularly to FIG. 11, there is shown the sheet material section 76 which is basically similar to prior sections 20 and 72. Again, like numerals have been employed to refer to like parts. It is to be noted that the section 76 is a stepped pattern configuration. The letters J, K and L are being used to refer to different sections of the stepped pattern. That means the slits 36 within the area J extend entirely across the sheet material section 76 from border section 40 to border section 41. Within area K, the slits 36 extend some shortened distance. Within area L, the slits 36 extend a still further shortened distance. The configuration of the slits 36 within area J is that of a rectangle which is also true of slits 36 within area K and area L. The sheet material section 76 is to be wound in the same manner as previously discussed on the core which is composed of inner member 42 and outer member 44 and cylindrical plug 52. The decorative ornament 78 that is produced using the stepped version of the sheet material section 76 is shown in FIG. 12. Again, like numerals have been employed to refer to like parts. The sheet material section 76 is to be a wound on the core again starting with the end of the section 72 that has the shortest length slits 36.

Figure 13:
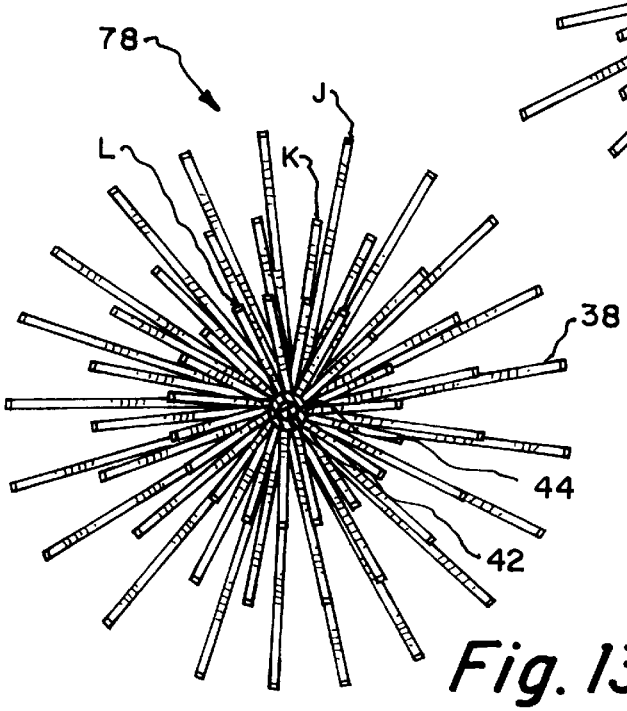
FIG. 13 is a cross-sectional view of the decorative ornament of the present invention taken along line 13—13 of FIG. 12.

Referring particularly to FIG. 13, the decorative ornament 78 of FIG. 12 is shown in transverse cross-section. It can be seen that the longer length slits 36 located within area J form narrow strips 38 that are located the furthest from the core. The slits of area K form strips that are located nearer the core. The slits within area L form strips 38 that are located nearest the core.

It is to be understood that following the concept of this invention that numerous other different configurations of slits 38 arranged within the sections 20, 72 and 76 could be utilized without departing from the scope of this invention.

What is claimed is:

1. An ornament comprising:

a core member terminating in a first end and a second end, said core member having a longitudinal center axis, said core member including adjustment means;

a sheet material member having a left edge and a right edge, said sheet material member being wound on said core member with said left edge located at said first end and said right edge located at said second end forming a plurality of layers at said first end and said second end, said sheet material member having a plurality of slits formed therein defining a plurality of narrow strips of material with there being a said narrow strip of material located between each directly adjacent pair of said slits, said plurality of layers being fixed to said first end and said second end; and said core member being movable by said adjustment means between an extended position and a shortened position, with said core member in said extended position said sheet material member defining a tubular configuration, with said core member in said shortened position said core member defining a globular configuration.

2. The ornament as defined in claim 1 where said adjustment means comprises:

said core member being formed of a plurality of parts which are movable relative to each other.

3. The ornament as defined in claim 2 wherein:

said core member being telescopingly adjustable.

4. The ornament as defined in claim 1 wherein:

said slits being evenly spaced-apart.

5. The ornament as defined in claim 1 wherein:

said slits being parallel to said longitudinal center axis.

6. The ornament as defined in claim 1 wherein:

said slits being located in the shape of a polygonally-shaped pattern.

7. The ornament as defined in claim 1 wherein:

said slits being arranged in a truncated-cone shaped pattern.

8. The ornament as defined in claim 1 wherein:

said slits being arranged in a stepped-pattern.

9. The ornament as defined in claim 1 including:

a decoration mounted on said core member and located internally of said sheet material member which is wound on said core member, said decoration being observable through said slits.

10. The ornament as defined in claim 1 wherein:

with said sheet material member being in a flat configuration prior to being wound on said core member said slits being in the configuration of a truncated cone.

11. The ornament as defined in claim 1 wherein:

with said sheet material member being in a flat configuration prior to being wound on said core member said slits being in a stepped-configuration.

12. An ornament comprising:

a sheet material member having a plurality of slits being wound on a core member with there being a strip located between each directly adjacent said slits forming a plurality of strips, said core member being adjustable between an extended position and a shortened position, with said ornament in said shortened position said sheet material member forming a globe-shape defined by said strips.

13. The ornament as defined in claim 12 wherein:

said core member being adjustable by being constructed of a plurality of members which are telescopingly connected together.

14. The ornament as defined in claim 12 including:

a decoration mounted on said core member with said sheet material member to surround said decoration, said decoration being observable through said slits.

15. The ornament as defined in claim 12 wherein:

with said sheet material member being in a flat configuration prior to being wound on said core member said slits being in the configuration of a polygon.

16. The method of a decorative ornament comprising the steps of:

utilizing an elongated rigid core which terminates in length in a first end and a second end and which is adjustable in length;

utilizing a section of a colorful, thin, sheet material;

cutting within said section a plurality of slits forming a plurality of thin, flimsy, sheet material, narrow strips with said strips terminating at opposite, solid, uncut edges;

winding and fixing one said edge several revolutions onto said first end and the remaining said edge several, revolutions onto said second end; and whereby different ornamental appearances of the decorative ornament can be achieved by adjusting of the length of the core with the overall appearance of the decorative ornament comprising a tube constructed of the thin, flimsy, sheet material, narrow strips.

17. The method of making a decorative ornament as defined in claim 16 wherein the cutting step includes:

arranging the slits to be within a polygonal-shaped pattern.

18. The method of making a decorative ornament as defined in claim 16 wherein the cutting step includes:

arranging the slits to be within a truncated cone pattern.

19. The method of making a decorative ornament as defined in claim 16 wherein the cutting step includes:

arranging the slits to be within a stepped pattern.

20. The method of making a decorative ornament as defined in claim 16 wherein:

mounting a decoration on the core which is to be observable through the slits producing a globe shaped for said decorative ornament.

* * * * *